US006508027B1

(12) United States Patent
Kim

(10) Patent No.: US 6,508,027 B1
(45) Date of Patent: Jan. 21, 2003

(54) ACCESSORY MOUNTS FOR FIREARMS

(75) Inventor: Paul Y. Kim, Westminster, CA (US)

(73) Assignee: Surefire, LLC, Fountain Valley, CA (US)

( * ) Notice: Subject to any disclaimer, the term of this patent is extended or adjusted under 35 U.S.C. 154(b) by 0 days.

(21) Appl. No.: 09/970,396

(22) Filed: Oct. 2, 2001

(51) Int. Cl.[7] ..... F41G 1/38
(52) U.S. Cl. ..... 42/124; 42/75.02; 42/90
(58) Field of Search ..... 42/90, 119, 124, 42/125, 138, 75.01

(56) References Cited

U.S. PATENT DOCUMENTS

| | | | | |
|---|---|---|---|---|
| 2,128,936 | A | | 9/1938 | Green |
| 2,287,066 | A | | 6/1942 | Rogers |
| 2,965,994 | A | | 12/1960 | Sullivan |
| 3,075,314 | A | | 1/1963 | Bakker |
| 3,090,150 | A | | 5/1963 | Stoner |
| 3,857,323 | A | | 12/1974 | Ruger et al. |
| 4,536,982 | A | | 8/1985 | Bredbury et al. |
| 4,627,183 | A | | 12/1986 | Stuckman |
| 4,663,875 | A | | 5/1987 | Tatro |
| 4,733,489 | A | | 3/1988 | Kurak |
| 4,742,636 | A | | 5/1988 | Swan |
| 4,845,871 | A | | 7/1989 | Swan |
| 5,010,676 | A | | 4/1991 | Kennedy |
| 5,092,071 | A | | 3/1992 | Moore |
| 5,111,587 | A | | 5/1992 | Plank |
| 5,142,806 | A | | 9/1992 | Swan |
| 5,198,600 | A | | 3/1993 | E'Nama |
| 5,201,135 | A | | 4/1993 | Cowles |
| 5,343,650 | A | | 9/1994 | Swan |
| 5,400,540 | A | * | 3/1995 | Solinsky et al. ..... 362/110 |
| 5,522,166 | A | * | 6/1996 | Martel ..... 42/124 |
| 5,533,292 | A | | 7/1996 | Swan |
| 5,590,484 | A | * | 1/1997 | Mooney et al. ..... 42/111 |
| 5,634,288 | A | | 6/1997 | Martel |
| 5,704,155 | A | | 1/1998 | Primeau, IV |
| 5,826,363 | A | | 10/1998 | Olson |
| 5,937,562 | A | * | 8/1999 | Brough ..... 250/206 |
| 6,012,374 | A | | 1/2000 | Brandl et al. |
| 6,385,892 | B1 | * | 5/2002 | Vendetti ..... 42/86 |
| 6,442,883 | B1 | * | 9/2002 | Waterman et al. ..... 42/124 |

OTHER PUBLICATIONS

United States Department of Defense, Military Standard: Dimensioning of Accessory Mounting Rail for Small Arms Weapons, Feb. 3, 1995.

* cited by examiner

*Primary Examiner*—Michael J. Carone
*Assistant Examiner*—Troy Chambers
(74) *Attorney, Agent, or Firm*—David Weiss

(57) ABSTRACT

An accessory mount for a firearm, that may be quickly, easily and firmly secured to a firearm, and quickly and easily removed from the firearm. In combination with a firearm including a receiver, a barrel longitudinally extending from the receiver, and a lug secured to the firearm above the barrel, the accessory mount includes a longitudinal mount body positioned along the barrel with the mount body's rear end supported by the receiver, a lever pivotally secured to the mount body's front end about a first transverse axis, the lever pivotally secured to the lug about a second transverse axis spaced along the lever from the first transverse axis, and a longitudinally adjustable member carried by the mount body for urging the lever to pivot about the second transverse axis to rearwardly urge the mount's rear end against the receiver.

31 Claims, 3 Drawing Sheets

ACCESSORY MOUNTS FOR FIREARMS

BACKGROUND OF THE INVENTION

This invention relates to accessory mounts for firearms, and more particularly to accessory mounts that may be quickly, easily and firmly secured to a firearm, and quickly and easily removed therefrom.

Various types of devices are useful as accessories for being mounted to firearms, examples of such accessories being target illuminators and laser sights. Such accessories are conventionally mounted to an interface apparatus descriptively referred to as an accessory mount, which has been secured to the firearm. Such accessory mounts may include rail interface systems well known in the art pertaining to firearms, and in particular with respect to submachine guns, carbines, rifles and other firearms used for military and police operations.

It is of utmost importance that the accessory mount be firmly secured to the firearm with the mounted accessories directed along the barrel, while at the same time it is desirable that the accessory mount be quickly and easily securable to and removable from the firearm.

SUMMARY OF THE INVENTION

Against this background, the present invention provides an accessory mount that may be firmly secured to a firearm along the firearm's barrel, and which is quickly and easily securable to and removable from the firearm. According to one aspect of the present invention, there is provided an accessory mount for a firearm having a longitudinal barrel and a receiver, the accessory mount comprising the combination of: a longitudinal mount body having a front end and a rear end, the mount body positionable along the barrel with the mount's rear end supported by the firearm's receiver; a lever pivotally secured to the mount body about a first transverse axis at the mount body's front end, the lever pivotally securable to the firearm about a second transverse axis spaced along the lever from the first transverse axis; and a longitudinally adjustable member carried by the mount body for urging the lever to pivot about the first transverse axis. Rearward adjustment of the longitudinally adjustable member, which in the preferred embodiment is a set screw in a threaded aperture longitudinally through the front end of the mount body, urges the lever to pivot about its second transverse axis for rearwardly urging the rear end of the mount body against the receiver when the lever is pivotally secured to the firearm with the rear end supported by the receiver.

The second transverse axis is preferably spaced along the lever above the first transverse axis, and the longitudinally adjustable member preferably contacts the lever below the first transverse axis. In a preferred embodiment, the lever includes a U-shaped portion having two legs spaced apart by a distance greater than the diameter of the firearm's barrel, and the lever includes a portion depending from the U-shaped portion for being contacted by the longitudinally adjustable member. The rear end of the mount body preferably includes at least one rearwardly extending projection insertable in a groove in the firearm's receiver about the barrel, for supporting the accessory mount's rear end.

According to another aspect of the present invention, firearm and accessory mount apparatus is provided comprising in combination: a firearm including a receiver and a barrel longitudinally extending from the receiver; a bracket or lug secured to the firearm above the barrel; a longitudinal mount body having a front end and a rear end, the mount body positioned along the barrel with the rear end supported by the receiver; a lever pivotably secured to the mount body about a first transverse axis at the front end of the mount body, the lever pivotally secured to the lug about a second transverse axis spaced along the lever from the first transverse axis; and a longitudinally adjustable member carried by the mount body for urging the lever to pivot about the second transverse axis to rearwardly urge the mount's rear end against the receiver. The second transverse axis is preferably spaced along the lever above the first transverse axis, and the longitudinally adjustable member contacts the lever below the first transverse axis. A preferred embodiment of the lever includes a U-shaped portion having two legs pivotally secured to the lug about the second transverse axis with the barrel disposed within the U of the lever, and the lever further includes a portion depending from the U-shaped portion for being contacted by the longitudinally adjustable member.

In a preferred embodiment, the firearm includes a groove in the receiver about the barrel, and the rear end of the mount body is supported within the groove; for example, the rear end of the mount body may include two rearwardly extending tabs inserted in the groove for supporting the rear end. Such tabs may include rearwardly facing respective surfaces and the groove may include a forwardly facing surface, the rearwardly facing surfaces of the tabs being urged against the forwardly facing surface of the groove when the lever is urged by the longitudinally adjustable member.

According to a further aspect of the present invention, an accessory mount is provided which comprises a longitudinal mount body securable to a firearm along the firearm's barrel, the mount body including a rail having longitudinally spaced-apart ribs and a channel longitudinally extending along the mount body through the ribs.

BRIEF DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
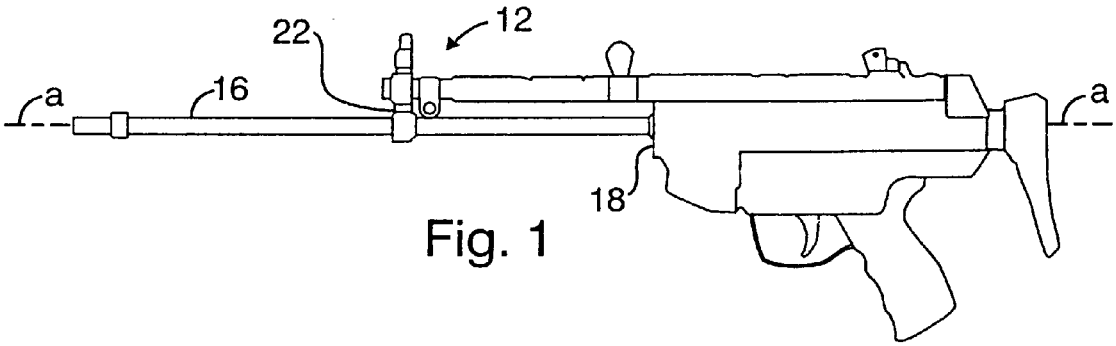
FIG. 1 is a side elevation view of an example of a firearm to which a preferred embodiment of an accessory mount according to the present invention may be secured.
Figure 2:
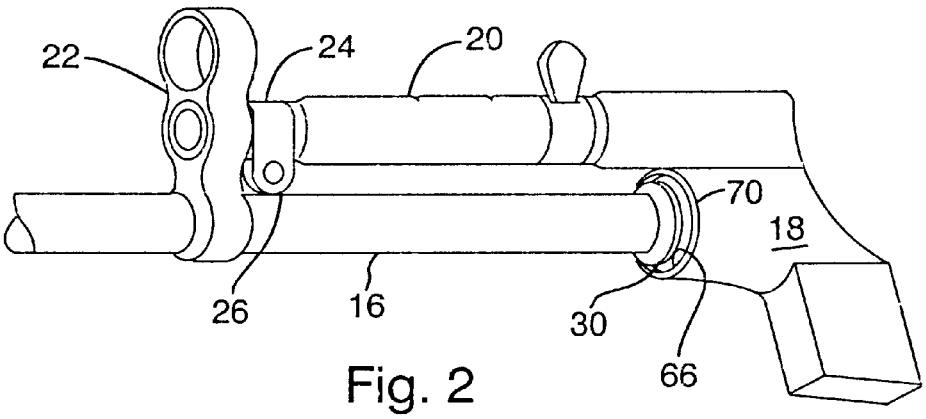
FIG. 2 is a fragmentary perspective view of a section of the firearm of FIG. 1, in increased scale, to which the preferred accessory mount embodiment of the present invention may be secured.
Figure 3:
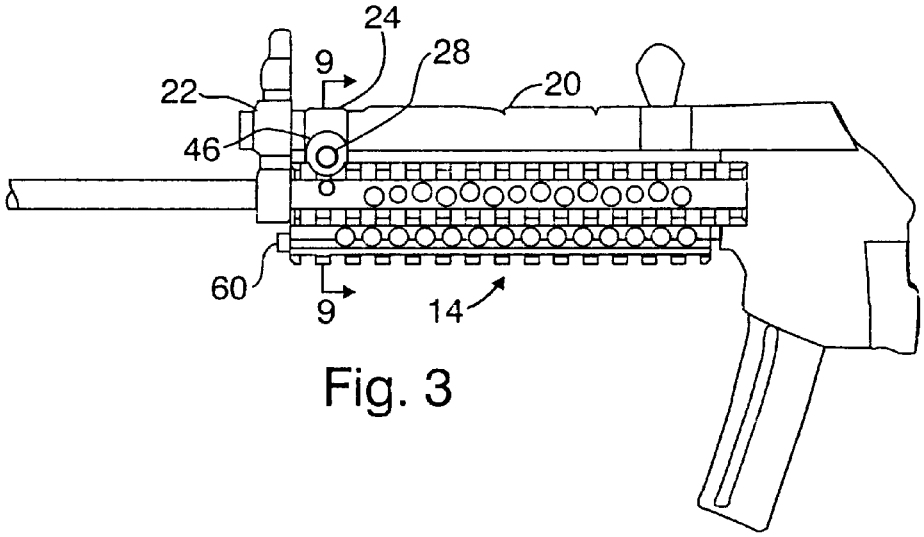
FIG. 3 is a side elevation view of the preferred embodiment of the accessory mount according to the present invention, secured to the rifle section shown in FIG. 2.

Turning first to FIGS. 1 and 2, there is illustrated an example of a firearm 12, specifically a submachine gun such as manufactured by Heckler & Koch, Inc. (of Sterling, Va.), to which a preferred embodiment of an accessory mount 14 according to the present invention may be equipped as shown in FIG. 3. The firearm 12 includes a barrel 16 extending along a longitudinal axis a from the firearm's upper receiver 18. A generally tubular housing 20, communicating with the upper receiver 18 and including devices instrumental in operating the firearm's firing mechanism, longitudinally extends above the barrel 16 and is secured at its front end to a front sight post 22 secured to the barrel 16. A bracket or lug 24 is secured to the firearm 12 above the barrel 16 forwardly of the barrel's connection to the receiver 18, such as to the tubular housing 20 at or near its connection to the front sight post 22. The lug 24 includes a transverse bore or pair of transversely aligned apertures 26 for holding a transversely extending pivot pin 28.

As used herein, the word "transverse" describes a horizontal direction perpendicular to the axis a when the barrel 16 is horizontally positioned in a firing position; "above" means vertically above when the firearm 12 is in a firing position with its barrel 16 horizontal; "below" means vertically below when the firearm 12 is in a firing position with the barrel 16 horizontal; "front" or "forward" describes the direction toward the muzzle of the barrel 16 (i.e., to the left as shown in FIGS. 1–3); and "rear" or "rearward" describes the direction opposite the front (i.e., to the right as shown in the drawing of FIGS. 1–3).

The firearm 12 includes an annular channel or groove 30 in the receiver 18 and concentric about the barrel 16, at the barrel's connection to the receiver 18.

Figure 4:
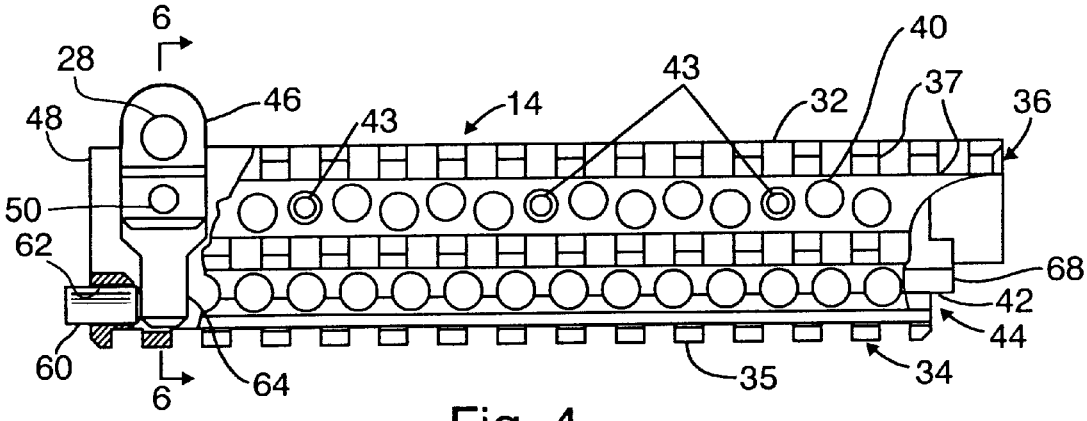
FIG. 4 is a side elevation view of the accessory mount of FIG. 3, in further increased scale, broken away at the front and rear ends to show the securement mechanisms thereat.
Figure 5:
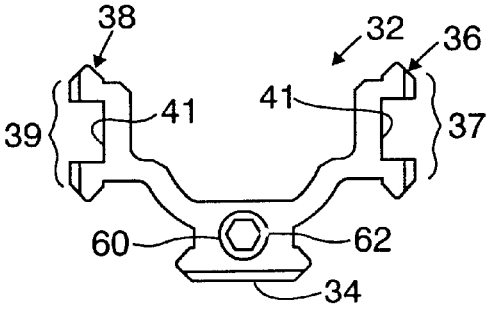
FIG. 5 is an elevation view of the front end of the accessory mount of FIG. 4.
Figure 6:
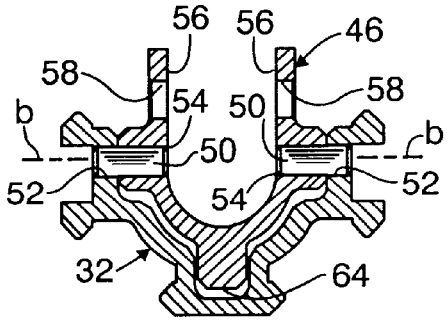
FIG. 6 is a cross-sectional view of the accessory mount of FIG. 4, taken along the line 6—6 of FIG. 4 in the direction of the appended arrows.
Figure 7:
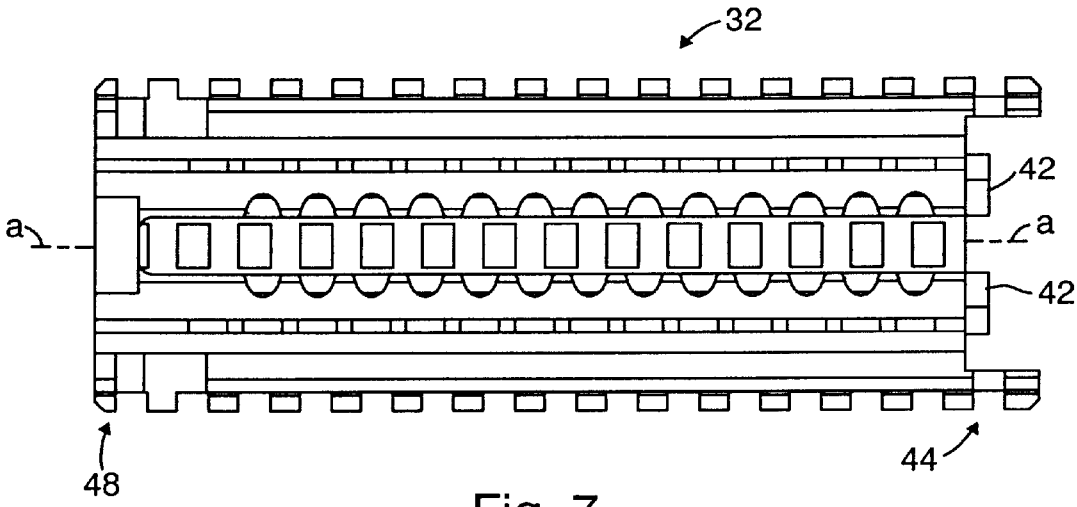
FIG. 7 is a top plan view of the body of the accessory mount of FIG. 4.
Figure 8:
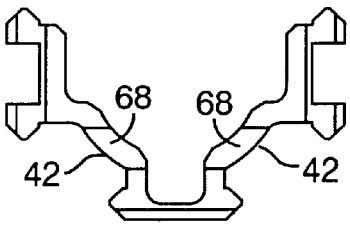
FIG. 8 is an elevation view of the rear end of the accessory mount of FIG. 4 as well as of the body of FIG. 7.

Turning to FIGS. 3–9, the preferred embodiment of the accessory mount 14 includes a generally semi-cylindrical shell or body 32 having at least one longitudinal rail structure therealong, such as a bottom rail structure 34 along the exterior underside thereof, and which also may include side rail structures 36, 38, to which may be mounted firearm accessories such as target illuminators, laser sights, and other devices. Rails for accessory mounts are well known in the firearms art, for example as contained on rail interface system devices such as manufactured by Knights Manufacturing Company (of Vero Beach, Fla.), including those disclosed in U.S. Pat. No. 5,826,363 of Douglas D. Olson, as well as those disclosed in U.S. Pat. No. 5,590,484 of Aurelius A. Mooney et al., both of which patents are incorporated herein by reference. One such prior art rail comprises a series of longitudinally spaced-apart ribs 35, such as specified in MIL-STD-1913 and commonly known as a Picatinny rail, which is shown in FIGS. 4 and 5 as comprising the bottom rail 36. Although such Picatinny rails may be used for the side rail structures 36, 38 as well, the preferred accessory mount 14 of the present invention includes a modified version of the Picatinny rail for the side rails 36, 38, which includes a slot or channel 41 longitudinally extending along the mount body 32 through the ribs 37 and 39, such ribs being oriented perpendicular to the longitudinal axis a. Either type of rail structure may be utilized for securing accessories having a Weaver style or other cooperating clamping device, although the provision of the channel 41 permits greater adaptability of accessory arrangement on a rail as well as additional types of securement opportunities. Further, the body wall of each channel 41 may include apertures 40 therethough, for weight and/or heat reducing purposes, as well as longitudinally spaced-apart apertures 43 preferably with internal threads for the securement of accessories by other securement devices (e.g. screws) instead of or in addition to securement by utilization of the rails 34, 36 or 38 alone.

Figure 9:
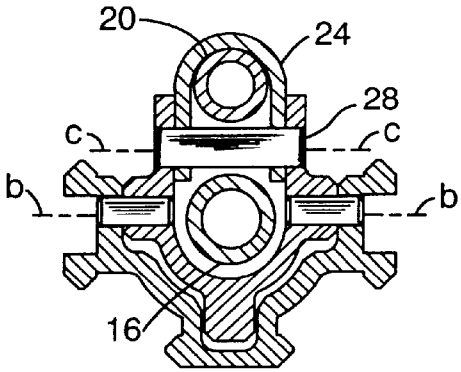
FIG. 9 is a cross-sectional view of the accessory mount and firearm combination of FIG. 3, taken along the line 9—9 of FIG. 3 in the direction of the appended arrows.

The body 32 of the preferred accessory mount 14 is adapted to be longitudinally positioned and secured to the firearm 12 laterally of and below a section of the barrel 16 (and accordingly commonly referred to as a "lower mount" body) extending substantially from the receiver 18 to the front sight post 22; i.e., the body 32 is positioned along the barrel 16 such that the barrel section longitudinally extends within the interior of the body 32 as illustrated in FIGS. 3 and 9. The mount body 32 includes at least one and preferably two rearwardly extending projections such as the arcuate tabs 42 (FIGS. 4, 7 and 8) positioned and dimensioned for being inserted into and vertically supported by the circular groove 30 of the receiver 18 so as to cause the mount's rear end 44 to be supported by the receiver 18 when the mount 14 is to be installed on the firearm 12.

The accessory mount 14 includes a pivot arm or lever 46 having a U-shaped portion (best shown in FIGS. 4 and 6) in the vicinity of the front end 48 of the body 32, pivotally secured to the body 32 about a first transverse axis b by such means as pivot pins 50 transversely extending through respective bores 52 through the sides of the body 32 and through respective bores 54 through the respective legs 56 of the U-shaped lever 46.

The lever 46 is pivotally securable to the firearm 12. In the preferred embodiment, the legs 56 of the U-shaped lever 46 include transversely aligned bores 58 spaced above the bores 54, through which the pivot pin 28 may be inserted and held by the legs 56 along a second transverse axis c spaced along the lever 46 above the first transverse axis b. The interior transverse spacing between the legs 56 of the U-shaped lever 46 is greater than the diameter of the firearm's barrel 16, permitting the accessory mount 14 to be installed on the firearm 12 with the firearm's barrel 16 accommodated within the U of the lever 46. The interior height of the legs 56 permit the lever 46 to be pivotably secured to the lug 24 by transversely aligning the lever's upper bores 58 with the lug's transverse bore or apertures 26 and securing the pivot pin 28 therethrough along the transverse axis c (see FIG. 9).

The lever 46 is urged to pivot about the first transverse axis b by means of a longitudinally adjustable set screw 60 in a threaded aperture 62 longitudinally extending through the front end 48 of the accessory mount body 32 (FIGS. 4 and 5), bearing against the forward facing surface of the lever 46 at a location spaced below the transverse axis b. For example, the set screw 60 may be longitudinally aligned for contacting a lever portion or appendage 64 downwardly extending from the base of the U of the U-shaped portion of the lever 46.

When installing the accessory mount 14 on the firearm 12, the user positions the accessory mount 14 such that its longitudinally extending rear projections or arcuate tabs 42 are inserted into the preferably fixed annular groove 30 in the firearm's receiver 18. The longitudinal length of the arcuate tabs 42 is preferably slightly greater than the longitudinal depth of the groove 30, and when positioned as described the tabs 42 are supported by the outer circumferential wall 66 of the groove 30 (FIG. 2). The user then adjusts the front end 48 of the mount 14 such that the upper apertures 58 in the lever 46 are transversely aligned with the bore or apertures 26 in the lug 24, and the user inserts the pin 28 through these aligned apertures 58 and 26 and secures the pin 28 in such position by any of a number of securing devices well known in the art (for example by a conventional snap fit detent device).

The user thereupon longitudinally adjusts the set screw 60 for contacting and rearwardly urging the lever appendage 64. Since the upper pivot axis c is fixed with respect to the firearm 12, screwing down on the set screw 60 causes the lever 46 to pivot about the fixed upper transverse axis c while the lower transverse axis b is caused to pivot about the fixed upper transverse axis c (in the counterclockwise direction as shown in the drawing of FIG. 4). Since the lower transverse pivot axis b is fixed with respect to the accessory mount housing 32, such rearward adjustment of the set screw 60 causes the mount body 32 to longitudinally move rearwardly, urging the rear faces 68 of the tabs 42 to contact and to be urged against the preferably fixed forwardly facing base or annulus 70 of the groove 30. In such manner, the accessory mount 14 is quickly, easily and firmly secured to the firearm 12 at the firearm's front lug 24 and the firearm's receiver 18.

The accessory mount 14 may be quickly and easily removed from the firearm 12 by reversing the installation procedure, i.e. by unscrewing or forwardly adjusting the set screw 60 sufficiently to release the tabs 42 from their pressure contact with the groove annulus 70, and removing the pivot pin 28.

In one example of the accessory mount preferred embodiment 14, for use with a Heckler & Koch MP5 submachine gun, the upper transverse axis c and the lower transverse axis b were spaced apart along the U-shaped lever 46 by a distance of approximately 0.50 inch, the vertical spacing between the center of the set screw 60 and the lower transverse axis b was approximately 0.73 inch, and the interior transverse distance between the legs 56 was approximately 0.73 inch. The length of the mount body 32 from its front end 48 to the rear faces 68 of the tabs 42 was approximately 5.75 inches, while the length of the longitudinal arcuate tabs 42 was approximately 0.15 inch.

The body 32 and lever 46 may be made using fabrication methods well known in the art, of well known materials typically used in the art of making firearm accessory mounts including metals such as lightweight aluminum alloys and other rigid and durable materials such as polymeric materials. Although the Heckler & Koch MP5 submachine gun has been illustrated by way of example herein, the mount of the present invention may be fitted for being installed on submachine guns of other manufacturers, as well as on rifles and carbines, and on any other firearm that has front and rear mounting points for accommodating the front pivot lever and rear support projections or tabs of the present invention.

Thus, there has been described a preferred embodiment of an accessory mount that may be easily, quickly and firmly secured to a firearm, and quickly and easily removed from the firearm, as well as a modified rail structure for an accessory mount. Other embodiments of the present invention, and variations of the embodiment described herein, may be developed without departing from the essential characteristics thereof. Accordingly, the invention should be limited only by the scope of the claims listed below.

I claim:

1. An accessory mount for a firearm having a longitudinal barrel and a receiver, the accessory mount comprising the combination of:

a longitudinal mount body having a front end and a rear end, said mount body positionable along the barrel with said rear end supported by the receiver;

a lever pivotally secured to said mount body about a first transverse axis at said front end, said lever pivotally securable to the firearm about a second transverse axis spaced along said lever from said first transverse axis; and a longitudinally adjustable member carried by said mount body for urging said lever to pivot about said first transverse axis.

2. The accessory mount according to claim 1, wherein:

said second transverse axis is spaced along said lever above said first transverse axis.

3. The accessory mount according to claim 2, wherein:

said longitudinally adjustable member contacts said lever below said first transverse axis.

4. The accessory mount according to claim 3, wherein:

said longitudinally adjustable member is a set screw within a threaded aperture longitudinally through said front end of said mount body.

5. The accessory mount according to claim 1, wherein:

said lever includes a U-shaped portion having two legs spaced apart by a distance greater than the diameter of the barrel of the firearm.

6. The accessory mount according to claim 5, wherein:

said lever includes a portion depending from said U-shaped portion for being contacted by said longitudinally adjustable member.

7. The accessory mount according to claim 5, the firearm including a lug secured thereto above the barrel, wherein:

said legs are pivotally securable to said lug about said second transverse axis with the barrel disposed within the U of said lever.

8. The accessory mount according to claim 1, the firearm including a groove in said receiver about said barrel, wherein:

said rear end of said mount body includes at least one rearwardly extending projection insertable in said groove for supporting said rear end.

9. The accessory mount according to claim 1, the firearm including a groove in said receiver about said barrel, wherein:

said rear end of said mount body includes two rearwardly extending tabs insertable in said groove for supporting said rear end.

10. The accessory mount according to claim 9, wherein:

said tabs include rearwardly facing surfaces and said groove includes a forwardly facing surface, said rearwardly facing surfaces of said tabs being urged against said forwardly facing surface of said groove when said lever is urged by said longitudinally adjustable member.

11. The accessory mount according to claim 1, wherein:

said longitudinally adjustable member is adjustable for urging said lever to pivot about said second transverse axis for rearwardly urging said rear end of said mount body against the receiver when said lever is pivotally secured to the firearm with said rear end supported by the receiver.

12. The accessory mount according to claim 11, wherein:

said second transverse axis is spaced along said lever above said first transverse axis.

13. The accessory mount according to claim 12, wherein:

said longitudinally adjustable member contacts said lever below said first transverse axis.

14. The accessory mount according to claim 13, wherein:

said longitudinally adjustable member is a set screw within a threaded aperture longitudinally through said front end of said mount body.

15. The accessory mount according to claim 11, wherein:

said lever includes a U-shaped portion having two legs spaced apart by a distance greater than the diameter of the barrel of the firearm.

16. The accessory mount according to claim 15, wherein:

said lever includes a portion depending from said U-shaped portion for being contacted by said longitudinally adjustable member.

17. The accessory mount according to claim 15, the firearm including a lug secured thereto above the barrel, wherein:

said legs are pivotally securable to said lug about said second transverse axis with the barrel disposed within the U of said lever.

18. The accessory mount according to claim 11, the firearm including a groove in said receiver about said barrel, wherein:

said rear end of said mount body includes at least one rearwardly extending projection insertable in said groove for supporting said rear end.

19. The accessory mount according to claim 11, the firearm including a groove in said receiver about said barrel, wherein:

said rear end of said mount body includes two rearwardly extending tabs insertable in said groove for supporting said rear end.

20. The accessory mount according to claim 19, wherein:

said tabs include rearwardly facing surfaces and said groove includes a forwardly facing surface, said rearwardly facing surfaces of said tabs being urged against said forwardly facing surface of said groove when said lever is urged by said longitudinally adjustable member.

21. Firearm and accessory mount apparatus, comprising in combination:

a firearm including a receiver and a barrel longitudinally extending from said receiver;

a lug secured to said firearm above said barrel;

a longitudinal mount body having a front end and a rear end, said mount body positioned along said barrel with said rear end supported by said receiver;

a lever pivotably secured to said mount body about a first transverse axis at said front end of said mount body, said lever pivotally secured to said lug about a second transverse axis spaced along said lever from said first transverse axis; and a longitudinally adjustable member carried by said mount body for urging said lever to pivot about said second transverse axis to rearwardly urge said rear end against said receiver.

22. The apparatus according to claim 21, wherein:

said firearm includes a groove in said receiver about said barrel; and said rear end of said mount body is supported within said groove.

23. The apparatus according to claim 22, wherein:

said rear end of said mount body includes at least one rearwardly extending projection inserted in said groove for supporting said rear end.

24. The apparatus according to claim 21, wherein:

said firearm includes a groove in said receiver about said barrel; and said rear end of said mount body includes two rearwardly extending tabs inserted in said groove for supporting said rear end.

25. The apparatus according to claim 24, wherein:

said tabs include rearwardly facing surfaces and said groove includes a forwardly facing surface, said rearwardly facing surfaces of said tabs being urged against said forwardly facing surface of said groove when said lever is urged by said longitudinally adjustable member.

26.The apparatus according to claim 21, wherein:

said second transverse axis is spaced along said lever above said first transverse axis.

27. The apparatus according to claim 26, wherein:

said longitudinally adjustable member contacts said lever below said first transverse axis.

28. The apparatus according to claim 27, wherein:

said longitudinally adjustable member is a set screw within a threaded aperture longitudinally through said front end of said mount body.

29. The apparatus according to claim 21, wherein:

said lever includes U-shaped portion having two legs spaced apart by a distance greater than the diameter of said barrel of said firearm.

30. The apparatus according to claim 29, wherein:

said legs are pivotally secured to said lug about said second transverse axis with said barrel disposed within the U of said lever.

31. The apparatus according to claim 29, wherein:

said lever includes a portion depending from said U-shaped portion for being contacted by said longitudinally adjustable member.

* * * * *